US005991581A

United States Patent [19]

Kwak et al.

[11] Patent Number: 5,991,581

[45] Date of Patent: Nov. 23, 1999

[54] DEVELOPMENT ROLLER CLEANING APPARATUS OF LIQUID ELECTROPHOTOGRAPHIC PRINTER

[75] Inventors: Jin-geun Kwak; Wan-ha Kim; Kee-son Chang, all of Suwon, Rep. of Korea

[73] Assignee: Samsung Electronics Co., Ltd., Kyungki-do, Rep. of Korea

[21] Appl. No.: 09/076,792

[22] Filed: May 13, 1998

[30] Foreign Application Priority Data

Aug. 27, 1997 [KR] Rep. of Korea ..... 97-23394

[51] Int. Cl.[6] ..... G03G 15/10

[52] U.S. Cl. ..... 399/237; 399/249

[58] Field of Search ..... 399/237, 249

[56] References Cited

U.S. PATENT DOCUMENTS 5,300,990 4/1994 Thompson ..... 399/240

5,374,980 12/1994 Kubo et al. ..... 399/249

5,758,236 5/1998 Teschendorf et al. ..... 399/249

FOREIGN PATENT DOCUMENTS 354115251A 9/1979 Japan .

*Primary Examiner*—William Royer

*Assistant Examiner*—William A. Noe

*Attorney, Agent, or Firm*—Sughrue, Mion, Zinn, Macpeak & Seas, PLLC

[57] ABSTRACT

A development roller cleaning apparatus includes a cleaning blade installed with an end contacting an outer surface of a development roller for removing an excess developer liquid therefrom, and a guide for guiding an excess developer liquid removed by a squeegee roller installed downstream from the development roller to the end of the cleaning blade.

3 Claims, 3 Drawing Sheets

DEVELOPMENT ROLLER CLEANING APPARATUS OF LIQUID ELECTROPHOTOGRAPHIC PRINTER

BACKGROUND OF THE INVENTION

1. Field of the Invention

The present invention relates to a liquid electrophotographic printer, and more particularly, to a development roller cleaning apparatus for removing an excess developer liquid and/or foreign particles remaining on the surface of a development roller which supplies a developer liquid to a photoreceptor medium.

2. Description of the Related Art

In an electrophotographic printer, an electrostatic latent image formed on a photoreceptor medium, such as a photoreceptor drum or a photoreceptor belt, is developed by using a developer liquid comprising a toner and a volatile carrier liquid. The developed image is then transferred to a sheet, thereby printing a desired image.

Referring to FIG. 1, a conventional liquid electrophotographic color printer includes a photoreceptor belt 110 supported by a plurality of rollers 121, 122 and 123 for circulating travel. As the photoreceptor belt 110 travels, a charging station 150 charges the surface of the photoreceptor belt 110 to a predetermined level. Then, a laser scanning unit 130 directs a laser beam onto the photoreceptor belt 110 according to image signals to form an electrostatic latent image thereon. Finally, a development station 140 supplies a developer liquid to develop the electrostatic latent image. As shown in FIG. 1, the color printer has a plurality of laser scanning units 130 and a plurality of development stations 140 corresponding to various colors.

With reference to FIG. 2, each of the development stations 140 includes a development roller 141, a cleaning roller 142 and squeegee rollers 144 and 146 positioned directly under the photoreceptor belt 110. Each development station accommodates a developer liquid 148 including a toner of a predetermined color mixed with a carrier liquid. A developer liquid supplier 143 provides the developer liquid 148 between the development roller 141 and the photoreceptor belt 110.

The squeegee rollers 144 and 146 remove the excess developer liquid from the photoreceptor belt 110. The removed developer liquid is recovered into the development station 140 via blades 145 and 147.

An image drying station 160 dries the carrier liquid of the developer liquid 148 adsorbed onto the electrostatic latent image of the photoreceptor belt 110. Thus, only the dried toner remains on the photoreceptor belt 110.

Subsequently, when the photoreceptor belt 110 passes between the roller 121 (FIG. 1) and the transfer roller 124, the developed image is transferred to a sheet 126, which is fed between the transfer roller 124 and a fixation roller 125. Thereafter, an erasure station 170 removes any electrostatic charge remaining on the photoreceptor belt 110.

Turning to FIG. 3, the cleaning roller 142 has a plurality of orifices for removing the developer liquid that fails to adsorb to the photoreceptor belt 110 and continues around the development roller 141. The orifices 142*a* penetrate the cleaning roller 142 from its center to its peripheral surface. Therefore, as the cleaning roller 142 rotates in contact with the development roller, the developer liquid 148' remaining on the development roller 141 travels through the orifices and collects in the bottom of the development station.

However, since the cleaning roller 142 requires a driver (not shown) and a developer liquid delivery device (not shown), the structure is complex. Also, fabricating the orifices is difficult. Finally, the friction between the oppositely rotating development roller 141 and cleaning roller 142 causes abrasions that shorten the life span thereof.

SUMMARY OF THE INVENTION

To solve the above problem, it is an objective of the present invention to provide a development roller cleaning apparatus for removing developer liquid remaining on the outer surface of a development roller while minimizing the contact area with the development roller.

To achieve the above objective, a development roller cleaning apparatus of a liquid electrophotographic printer comprises a developing roller for delivering a developer liquid supplied from a developer liquid supplier to a photoreceptor medium, a cleaning blade installed with an end in contact with the outer surface of the development roller, for removing excess developer liquid remaining thereon, a squeegee roller installed on a downstream side of the development roller, for removing excess developer liquid remaining on the photoreceptor medium, and a guide for guiding the excess developer liquid removed by the squeegee roller to the end of the cleaning blade and mixing the same with the excess developer liquid removed by the cleaning blade.

The guide comprises an edge portion in contact with the outer surface of the squeegee roller, and a guiding portion bent and extended from the edge portion to face the cleaning blade to form a space between the cleaning blade and the guide.

The above and other features of the invention including various and novel details of construction and combination of parts will now be more particularly described with reference to the accompanying drawings and pointed out in the claims. It will be understood that the particular development roller cleaning apparatus embodying the invention is shown by way of illustration only and not as a limitation of the invention. The principles and features of this invention may be employed in varied and numerous embodiments without departing from the scope of the invention.

BRIEF DESCRIPTION OF THE DRAWINGS

The above objective and advantages of the present invention will become more apparent by describing in detail a preferred embodiment thereof with reference to the attached drawings in which.

DESCRIPTION OF THE PREFERRED EMBODIMENTS

Figure 1:
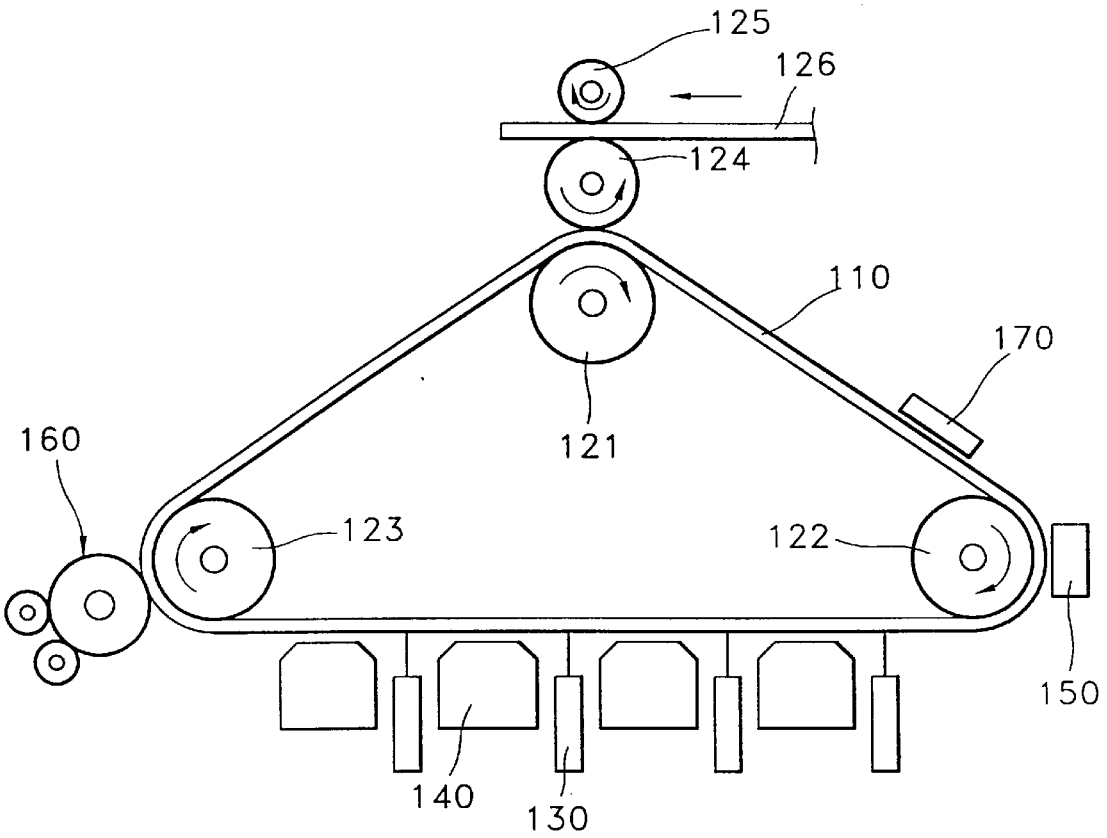
FIG. 1 (PRIOR ART)
FIG. 1 is a schematic diagram of a conventional liquid electrophotographic printer.
Figure 2:
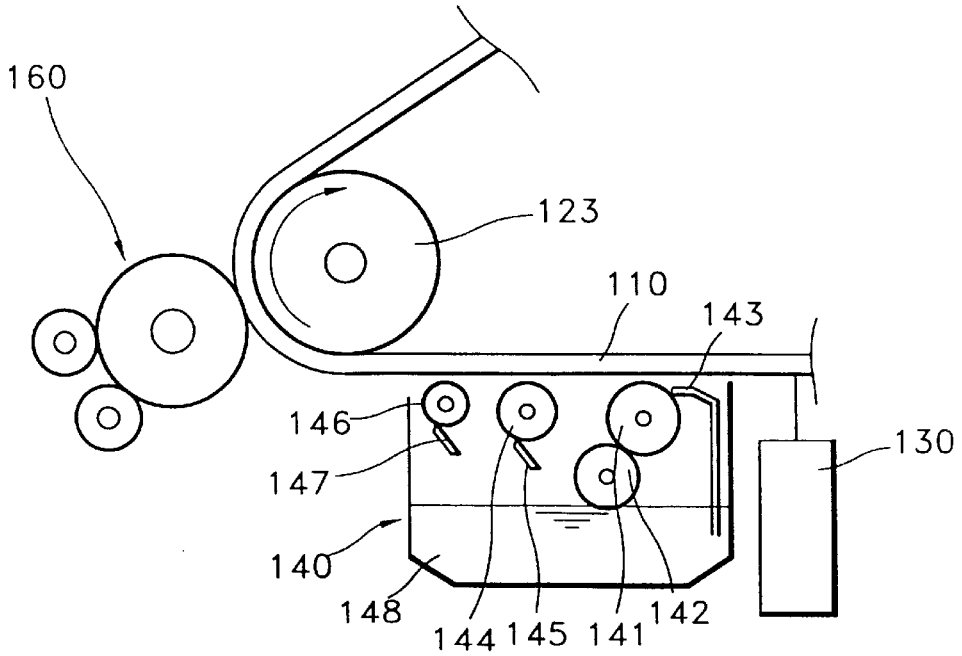
FIG. 2 (PRIOR ART)
FIG. 2 is a schematic diagram of a development station shown in FIG. 1.
Figure 3:
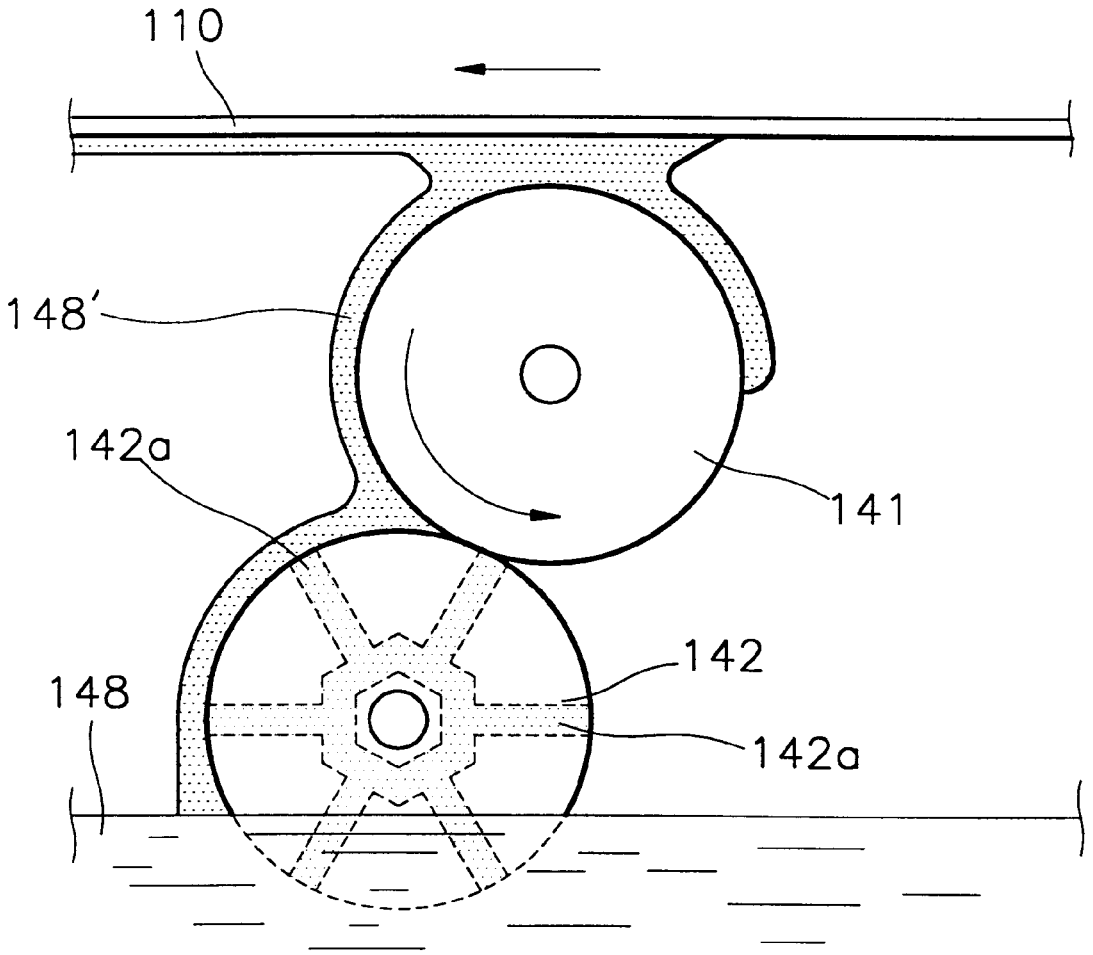
FIG. 3(PRIOR ART)
FIG. 3 is a side view of a cleaning roller shown in FIG. 2.
Figure 4:
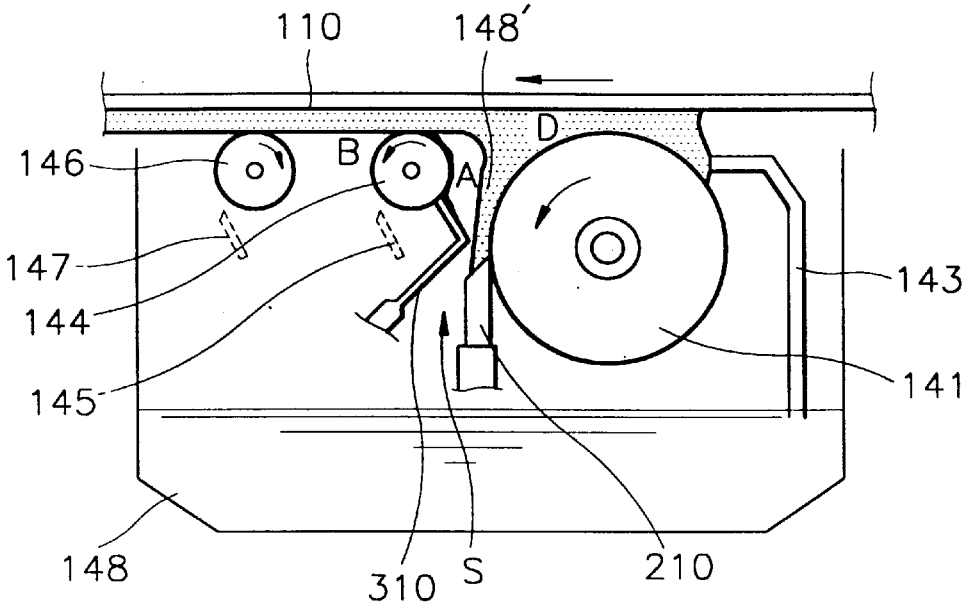
FIG. 4 is a schematic view of a development roller cleaning apparatus of a liquid electrophotographic printer according to the present invention.
Figure 5:
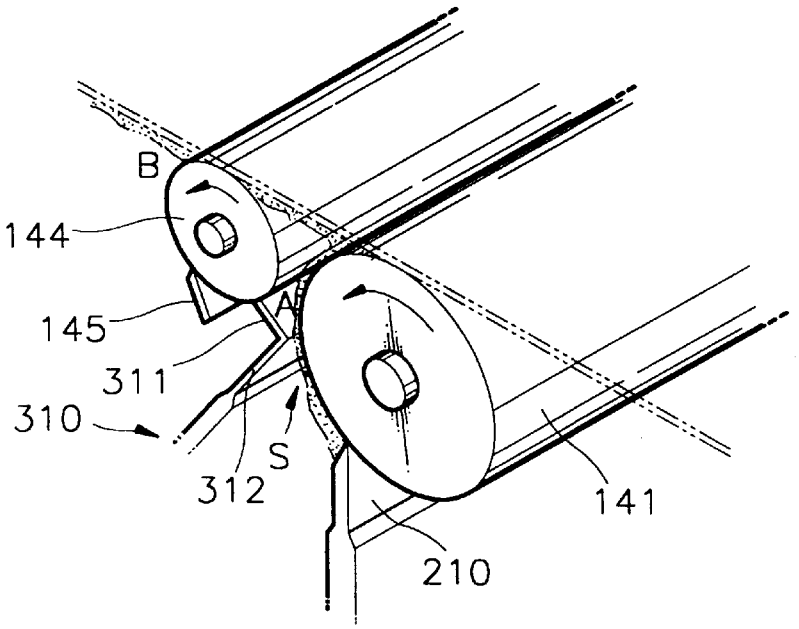
FIG. 5 is a partial perspective view of FIG. 4.

Referring to FIGS. 4 and 5, a development roller cleaning apparatus of a liquid electrophotographic apparatus according to the present invention will be described in detail. The same reference numerals as those described above represent the same elements.

The present development roller cleaning apparatus includes a cleaning blade 210 installed such that an end contacts the outer surface of a development roller 141, and a guide 310 for guiding developer liquid removed from the photoreceptor belt 110 by the squeegee roller 144 to the end of the cleaning blade 210.

The guide 310 includes an edge portion 311 abutting the outer surface of the squeegee roller 144 and a guiding portion 312 extending from the edge portion 311 to face the cleaning blade 210. Thus, a space S is defined between the cleaning blade 210 and the guide 310. Preferably, the guide 310 is formed of an elastic body such as a leaf spring so as to elastically contact the rotating squeegee roller 144.

According to the present invention, the excess developer liquid 148', not adsorbed onto the photoreceptor belt 110, passes the development portion D and back-plates on the surface of the development roller 141. This developer liquid 148' is removed by the end of the cleaning blade 210.

The squeegee roller 144, installed on the downstream side of the development roller 141 and pressed against the photoreceptor belt 110, also removes excess developer liquid 148'. A small amount of the removed developer liquid 148' is carried toward a portion 'B', that is, in the traveling direction of the photoreceptor belt 110. The majority of the removed developer liquid 148', on the other hand, flows along the surface of the squeegee roller 144 toward a portion 'A' between the development roller 141 and the squeegee roller 144.

The excess developer liquid 148' flowing toward the portion 'A', between the development roller 141 and the squeegee roller 144, is removed by the edge portion 311 of the guide 310 and guided toward the end of the cleaning blade 210. The developer liquid 148' guided by the edge portion 311 of the guide 310 mixes with the excess developer liquid removed from the development roller 141 by the end of the cleaning blade 210. This mixture is then recovered into the bottom of the development station 140 via the space S between the guiding portion 312 and the cleaning blade 210.

According to the development roller cleaning apparatus of the present invention, when the excess developer liquid remaining on the development roller is removed by a cleaning blade, the efficiency of the removal is significantly increased due to the flow rate and flux of the excess developer liquid guided by the guide 310 and mixed therewith.

What is claimed is:

1. A development roller cleaning apparatus of a liquid electrophotographic printer comprising:

a development roller with an outer surface for delivering a developer liquid to a photoreceptor medium;

a cleaning blade installed with an end contacting the outer surface of the development roller, for removing an excess developer liquid remaining on the development roller;

a squeegee roller installed on a downstream side of the development roller, for removing an excess developer liquid remaining on the photoreceptor medium; and a guide for guiding the excess developer liquid removed by the squeegee roller to the end of the cleaning blade, such that, as the excess developer liquid remaining on the development roller is removed by the cleaning blade, the excess developer liquid removed by the squeegee roller mixes therewith.

2. The development roller cleaning apparatus according to claim 1, wherein the guide comprises:

an edge portion contacting the outer surface of the squeegee roller; and a guiding portion extending from the edge portion to face the cleaning blade, thereby forming a space between the cleaning blade and the guide.

3. The development roller cleaning apparatus according to claim 1, wherein the guide is an elastic body.

* * * * *